United States Patent [19]

Kelley et al.

[11] 4,213,324

[45] Jul. 22, 1980

[54] PUNCH PRESS AND METHOD FOR MAKING CAN ENDS WITH CLOSURES

[75] Inventors: John S. Kelley, Wenham; Frederick G. J. Grise, Osterville; Walter C. Lovell, Wilbraham, all of Mass.

[73] Assignee: USM Corporation, Farmington, Conn.

[21] Appl. No.: 926,881

[22] Filed: Jul. 21, 1978

[51] Int. Cl.[2] ..... B21D 43/05

[52] U.S. Cl. ..... 72/405; 113/1 F; 113/121 C

[58] Field of Search ..... 113/1 F, 15 A, 113 R, 113/113 C, 114 R, 114 A, 25, 27, 121 R, 121 C; 72/420, 422, 428, 405, 361; 198/345, 656; 83/405, 409.1, 409.2, 412, 414, 415, 418, 445, 278

[56] References Cited

U.S. PATENT DOCUMENTS

| | | | |
|---|---|---|---|
| 2,295,852 | 9/1942 | LeJeune | 72/422 |
| 2,401,208 | 5/1946 | Walensky | 83/414 |
| 3,368,383 | 2/1968 | Marszal | 113/113 R |
| 3,964,414 | 6/1976 | Gane | 113/121 C |
| 3,981,652 | 9/1976 | Lovell et al. | 113/121 C |
| 4,031,836 | 6/1977 | Grise | 113/1 F |

*Primary Examiner*—Lowell A. Larson

*Attorney, Agent, or Firm*—Owen J. Meegan; Richard B. Megley; Vincent A. White

[57] ABSTRACT

A punch press comprising multi-station, progressive die tooling, for providing metal covers with easy-open closures, is fitted with a work transfer mechanism facilitating successive positioning of the covers, the tooling employing features thereof to precisely locate and align the covers in the respective stations. More especially, in addition to cover operating dies and work supporting members facilitating lateral accommodation and positioning of the covers to avoid unwanted deforming stress therein, correct vertical alignment of the tooling at successive stages to produce the closures is economically assured.

In its method aspect the invention consists in suspending can ends in their flanges in pockets of an indexable carrier, providing a die registering feature in each can end, and a die at successive stations of the press for mating with the feature, registrability of the die being accurately assured by relieving pressure between the carrier and each flange immediately preceding die closure whereby the can ends can self-adjust their position heightwise and laterally and at the same time avoid undue stress in each cover at die closures thereby minimizing unwanted distortion or deformation.

10 Claims, 7 Drawing Figures

PUNCH PRESS AND METHOD FOR MAKING CAN ENDS WITH CLOSURES

CROSS-REFERENCE TO RELATED APPLICATION

Application Ser. No. 908,733, for United States Letters Patent was filed May 23, 1978, in the names of John S. Kelley et al and pertains to a method of making sheet metal can ends with easy-open closures. The method, briefly, contemplates that, after a cover is formed with a closure by scoring-to-fracture, a ridge or rib of swageable metal will be provided precisely along an edge of the line of fracture, and then the rib will be swaged into rupturably locked sealing relation across the fracture whereby the integrity of the closure is assured but is manually openable.

BACKGROUND OF THE INVENTION

This invention relates to the volume production of easy-open can covers or can ends. More particularly the invention is concerned with providing an improved progressive punch press and production technique for making large quantities of sheet metal can covers formed with integral "push-button" type easy-open closures. While the invention will be described in relation to mechanism for practicing the method disclosed in the above-cited application for purposes of illustration, it will be recognized that in various aspects the invention is not thus limited in use, nor necessarily to the making of any particular type of easy-open can end.

Systems for producing can ends have hitherto employed a punch press with sequentially operated stations and carrier means (for instance a linearly moving belt or turret-like guide ring) having pockets for holding and transferring each can end from station-to-station by engagement with the curled outer flange, countersink, or periphery of the respective ends. Where can covers, ends, caps or like articles need not be made with precision, as where there is fairly broad dimensional tolerance on the outer profile of the item, for instance, such approaches have been reasonably acceptable. Typical transfer systems used with conversion presses do not, however, afford locating accuracy not to exceed, say 0.0015 inches in "Total Indicated Reading", and such accuracy is highly desirable in the production of many workpieces such as easy-open covers of the type above indicated.

In transferring the work from station-to-station between upper and lower cooperative forming tools, a spring means has served as the press opens to lift the can end carrier means clear of the dies thus to provide clearance for work advancement to a next station. Conversely, upon press closing of an upper die, usually acting through a countersink guide ring, the can end has been depressed and the curled or flanged can end periphery brought to bear with pressure upon the carrier means. These practices impose constraints that preclude exact self-alignments of the work, or critical portions thereof, at each station with respect to its tooling. It is appreciated that these basic elements of the can end transfer means, whether of the belt or guide ring type, are well accepted in the industry and in general desirably are to be retained.

By way of illustrating a can end production system wherein the apparatus includes end sequencing and, additionally, tear tab processing, reference may be had to U.S. Pat. No. 3,196,817 of July 27, 1965.

It has been discovered that for precision die operations to be performed sequentially in sheet metal, especially those wherein manually openable weakening lines of closures are to be uniformly and repeatedly produced with their sealing integrity consistently intact, stress loads to the point of deformation must be avoided. While lateral registration of the work relative to the cooperative dies when presented by the work transfer means is of some importance, it has been found that it is of at least equal importance to the avoidance of high stress loads at the closure within a cover or can end to attain precise vertical alignment of the cooperating dies with the work at the successive stages. Accordingly, the present invention contemplates the use of work-supporting and indexing mechanism for yieldably acting on the can end outer margins and allowing the can ends to be self-accommodating laterally and heightwise at the different stations. This is to say that, by reason of the "give" and reduction in slidable friction afforded to each workpiece as a whole by a yieldable clamping of the outer margin thereof, its closure portion can be progressively made substantially stress-free, and refined in its exact form, position, and potential operating condition by successive working of the cooperative pairs of upper and lower forming, coining and swaging dies. This procedure contrasts with prior art in which the workpiece is rigidly held causing the dies operable thereon to induce localized stresses often exhibited in a warped product; in fact, the lack of "give" in such prior practice with can ends may induce inconsistency and actual premature separation of the metal edges defining a weakening line.

SUMMARY OF THE INVENTION

In view of the foregoing it is an object of this invention to provide in a punch press having carrier means for sequentially moving sheet metal workpieces to and through successive work stations for performing forming operations thereon, each of the stations comprising upper and lower cooperative forming dies, mechanism for relieving clamping pressure between the periphery of the sheet metal and the carrier means during press closure whereby the dies themselves can, by interaction, locate each workpiece portion of the metal as required for precision alignment therebetween.

Another object of this invention is to provide an improved punch press having a plurality of stations cyclically operable, for making sheet metal can ends respectively incorporating an internal easy-open closure, the press to utilize only upper forming tools during closure of the press to precisely locate and accommodate the ends relative to cooperative lower forming tools, such location to be achieved without adverse stress forming constraint being imposed by a carrier of the ends.

The invention further contemplates, in another aspect, providing a method of accommodating sheet metal can ends to be formed with integral push-in type closures in the successive forming stations of a press, the press comprising a movable carrier having pockets for transferring the ends to sequential forming stations and between closeable forming dies thereof, said method consisting of initially forming the ends respectively with peripheral curled flanges for suspending the ends in said pockets and an internal die registering surface feature, and maintaining registrability of at least one of the dies at each successive station with said feature by relieving pressure and hence constraining friction between said flanges and the carrier immediately preceding each closure of the dies whereby the ends can slidably accommodate and self-position themselves in the pockets and laterally and heightwise of the dies for critical forming of the closures.

Preferably, and as herein shown, the carrier which may for instance be of belt or turrent type, is yieldingly movable heightwise between limits as well as being advanceable in the can end feeding direction, spring means being provided for urging the carrier relatively upwardly from the lower forming tools during opening of the press; during initial movement toward closure operation of the upper forming tools the carrier is yieldably depressed sufficiently to relieve bearing pressure between the ends and the carrier immediately prior to each tool closure. A ring associated with the upper forming tools is accordingly shown as employed with a plurality of depressors spaced for effecting decreased resistance to lateral sliding and hence uniformly precise die positioning of the can end and its several portions at the successive stations. The ability of each can end, in the arrangement as herein provided, to align and locate itself precisely for the successive closure forming operations enables the press to be constructed ruggedly and without costly and special work positioning means; of even greater significance the can end production can be at high rate with remarkably uniform dimensional output and improved predictability of performance in ultimate consumer usage.

BRIEF DESCRIPTION OF THE DRAWINGS

The foregoing and other features of the invention will now be more particularly described in connection with an illustrative embodiment and with reference to the accompanying drawings thereof, in which.

DESCRIPTION OF PREFERRED EMBODIMENT

Figure 1:
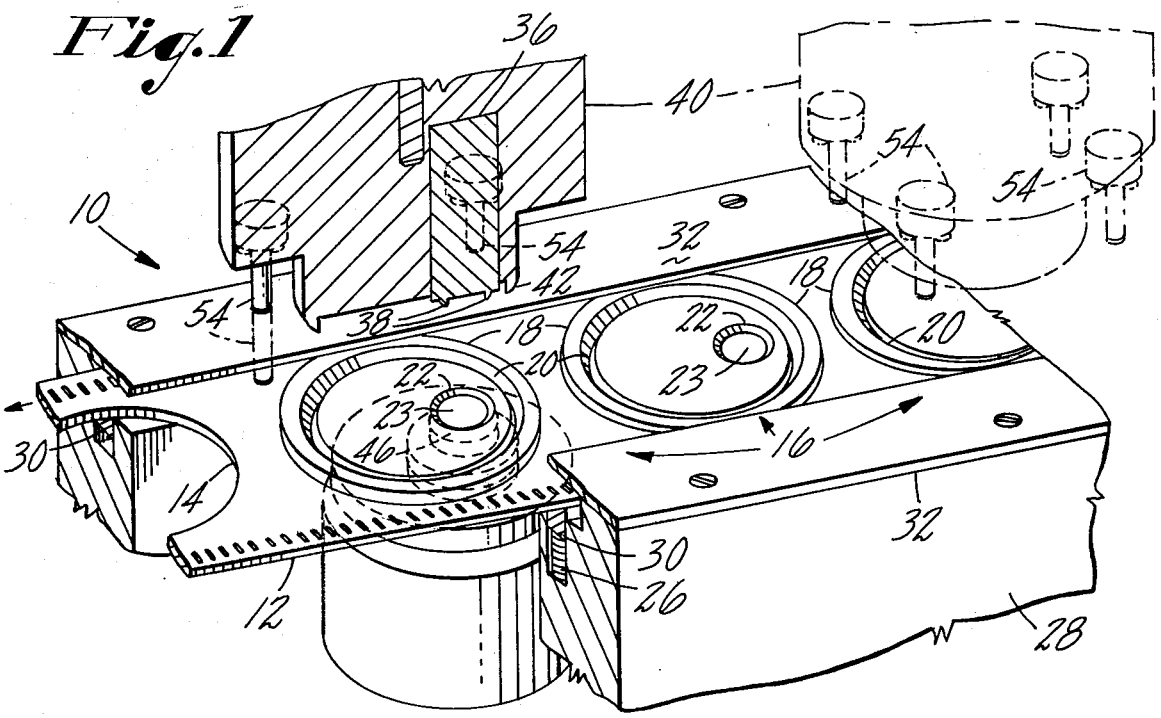
FIG. 1 is a perspective view, with portions broken away to reveal construction, or part of a can-end and closure making machine showing transfer mechanism (for instance, a carrier or belt) for conveying a strip of sheet metal stock to and between successive cooperative die operating stations.

This invention may be employed in can-end closure making machines and systems of different types and regardless of whether successive punch press stations thereof are arranged in rotary turret formation or in in-line structure. For present purposes of illustration only, a machine generally designated 10 (FIG. 1) to be described, is assumed to comprise a rectilinearly fed carrier in the form of a sprocket driven belt 12 of sheet metal. The belt is formed with a row of uniformly spaced openings or pockets 14 for respectively loosely supporting and indexing at successive can-end and closure forming stations, arranged along the path of the belt, can ends generally designated 16. It will be understood the ends 16 may be of any desired configuration, their circular shapes shown being selected merely for simplicity. As indicated in FIGS. 1 and 2, it may be assumed that at preceding stations, not shown, each generally planar can end 16 has been formed with a peripheral flange or curl 18, an outer channel 20 extending substantially parallel to the can end margin, and an inner, registerable groove or channel 22 usually of less depth defining, at least in part, a button-like panel portion 23 which is to be made into an easy-open closure 24.

The closure 24, which need not be circular, may be fabricated in accordance with any of a number of techniques for providing suitable fluid sealing of the can contents yet enable convenient digital opening thereof ultimately. Thus the closure may become a tab-type openable outwardly of its container, or a push-in type better adapted to ecological purposes. In either category the easy-open closure 24 is defined by a peripheral weakening line in the thin sheet metal along which the critical rupture is to occur. Creation of this line in malleable sheet metal or in tougher sheets such as those of steel requires a high order of accuracy in die operations, repeatable in millions of cycles, for attainment of uniform reliable openings. Typical work transfer systems in the prior art used with conversion presses do not possess this accuracy or they impose constraints which preclude use of self-aligning techniques. Having particular advantage in making weakening lines characterized by a fractured section, for purposes of illustration the invention will hereinafter be described as applied to the novel can end positioning method and machine 10 shown for making the closures 24 in a "pop-in" type, for instance the closure disclosed in U.S. Pat. No. 3,881,630 and utilizing the method disclosed in the above-cited patent application Ser. No. 908,733.

Figure 2:
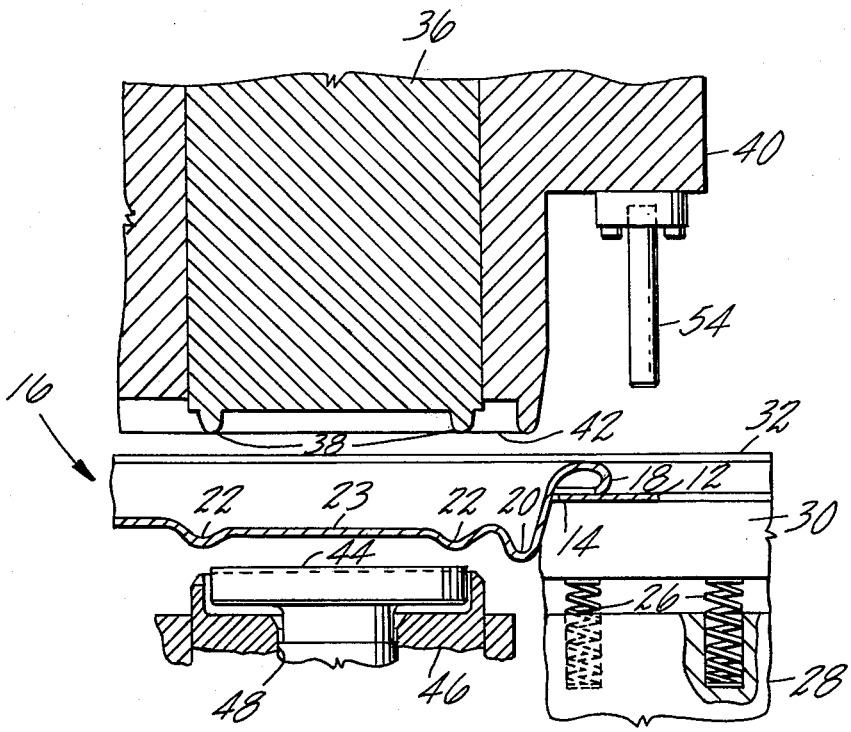
FIG. 2 is an enlarged vertical section at one of the stations of FIG. 1 showing a partly formed can end supported in a pocket of the transfer belt and, in this and subsequent stations, is to be provided progressively with an easy-open closure, upper and lower cooperative dies together with an ejector tool being indicated.
Figure 3:
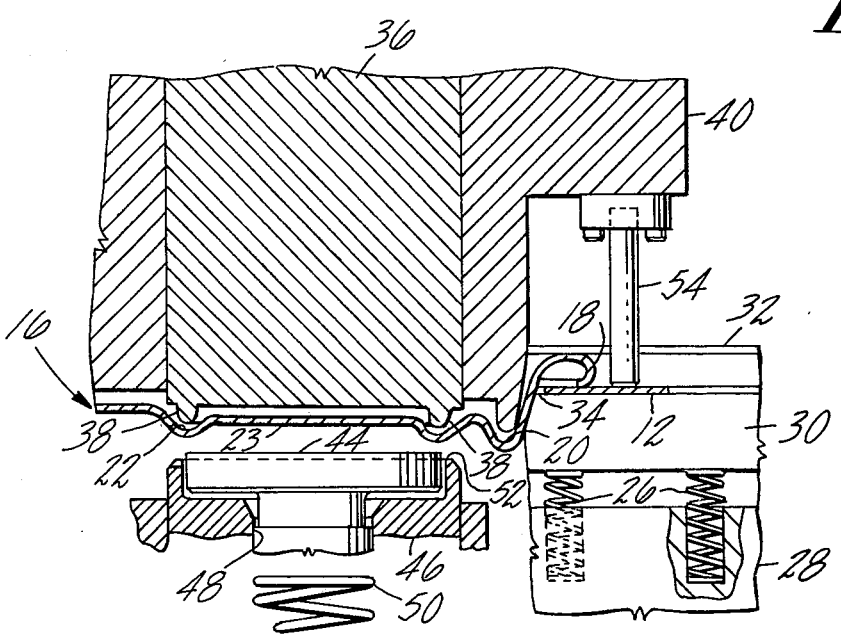
FIG. 3 is a view similar to FIG. 2, but showing parts at a subsequent stage wherein the upper forming die and a countersink ring have approached the can end, the die not yet engaging the can closure periphery as depressors of the ring cause the belt to be yieldingly lowered to allow pressure between the curled flange of the can end and the belt to be relieved.
Figure 4:
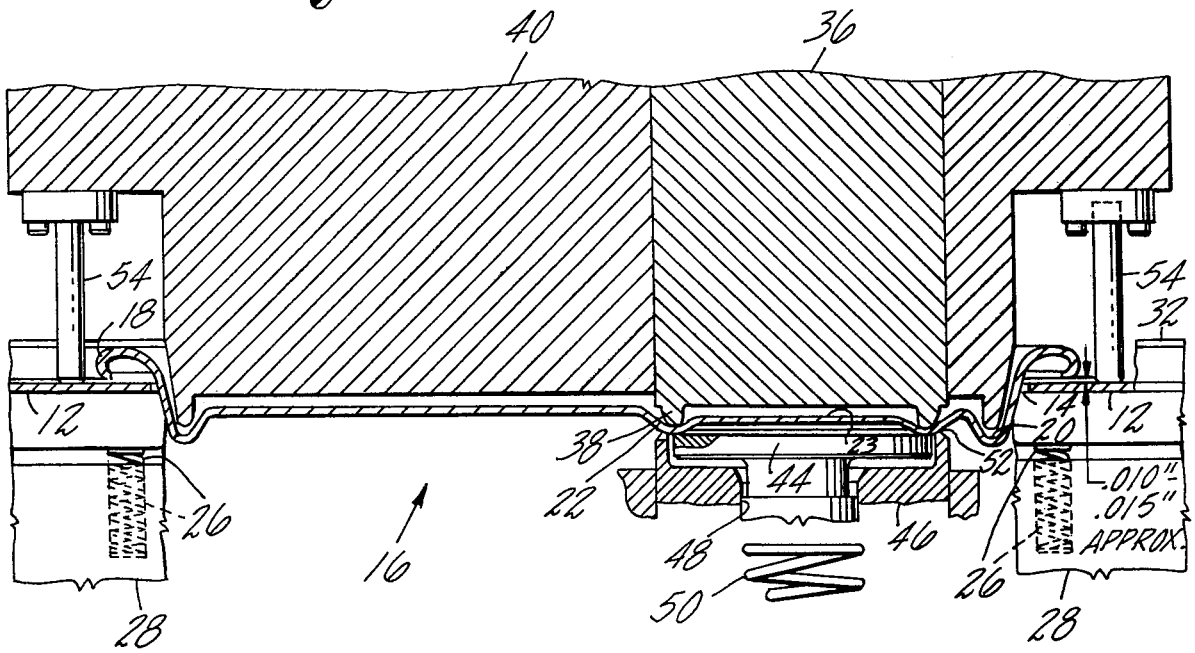
FIG. 4 is an enlarged section similar to FIG. 3 except that the upper and lower dies are now at a subsequent cooperative stage wherein a weakening line is formed in the closure periphery as the can end periphery is unconstrained, and for this purpose the hold down load has been transferred from the depressors to the closure making dies in the course of formation.

As the belt 12 is advanced to the left (as shown in FIG. 1) it carries each can end 16 station-to-station between upper and lower tooling sets cyclically cooperative along coaxial vertical axes. As heretofore, opposite margins of the belt are spring loaded upwardly as by a plurality of springs 26 (FIGS. 1,3,4) spaced, respectively, in bores located along a machine frame 28 and bearing upwardly against vertically yieldable horizontal supports 30,30 over which the belt margins advance. A pair of upper limit members 32,32 secured on the frame extends longitudinally of the belt and overhangs its opposite margins to provide a running fit therefor. As indicated in FIG. 3, for instance, each pocket 14 provides a small but important radial clearance 34 allowing clearance without constraint for the exterior wall or periphery of the can end thus to facilitate self-accommodation thereof in advantageous manner. Spring loading upwardly of the belt 12 as above explained is not new in that it is conventional to thus lift the can end up from the lower tools as the press opens thereby providing clearance of lateral feeding of the can end to the next station. Also, it may be incidentally noted that it is not new upon press closure to have operation of the upper tooling effect depression of a firm clamping means upon a feed belt (or equivalent), such loading commonly being done through a countersink type guide ring and its engagement with a curled flange of the can end periphery.

Before describing the particular sequence of operations depicted in FIGS. 2–5 inclusive, a brief statement generally distinguishing important features of the present invention is in order. An upper closure forming tool 36 (FIGS. 1 and 2) having an (in this instance) annularly projecting rounded ridge 38 is used as the dowelling and only contact loading device between the upper tools and the can end 16 during press closure. The contour of the ridge 38 will substantially correspond to that of the groove 22. The tool 36 axially projects from and is carried by a vertically reciprocable countersink ring 40. Thus, both successively and progressively, the tool 36 with its ridge 38 shaped to be received in the formed groove 22, will be employed to accurately locate and effect operations in the end 16 as the latter is permitted to be accommodated both heightwise and laterally as next explained. In the course of the closure making vertical loading is increasingly shifted to the tool 36 by means to be described next.

Referring to FIG. 2, the ring 40 is formed with a depending annular guide portion 42 adapted to loosely nest in and positionally engage the wall of the outer channel of the can end thereby to generally locate the end prior to engagement of the ridge 38 therewith as shown in FIG. 3. It will be understood that the pocket 14 itself can optionally be used for this purpose. FIG. 3 shows parts including the tool 36 and the ring 40 in an intermediate heightwise position as they descend, relatively, from their position shown in FIG. 2 to that indicated in FIG. 4 with respect to a coaxially aligned knock-out 44 yieldably mounted in a lower scoring tool 46. The tool 46 includes a guide bore 48 in which a stem of the knock-out may be urged heightwise under the influence of a return spring 50 which, when not stressed, positions the flat upper surface of the knock-out just above a flat working end 52 (FIG. 5) of the scoring-to-fracture tool 46. It will be understood that the end 52 is preferably of a configuration adapted to score-to-fracture in cooperation with the ridge 38.

The countersink ring 40 is provided with axially disposed hold downs or depressors 54, herein shown in FIG. 1 as four in number, equi-angularly spaced. These depressors are arranged to abut endwise the belt 12 in localities adjacent to the peripheral flange or curl 18 of the end 16, the belt thereby being engaged and yieldably displaced slightly beneath the members 32,32 as shown in FIG. 3, just before or substantially simultaneously with contact of the ridge 38 and the wall of the groove 22. Accordingly the can end 16 is being relieved of pressure exerted laterally and/or upwardly on its flange portion 18 by the belt 12 as the forces which have been applied by the countersink ring are being shifted to the more precise locating action of the tool 36. In the course of this transition the sheet metal of the end 16, and more especially of its closure panel 23, is thus enabled to be accurately coaxially aligned by the tool 36 with the lower scoring tool 46. Moreover, stresses in the can end which may have been in localized concentration as a result of prior forming and/or its margin being clamped, will be dispersed or relieved as its metal, especially in the panel 23, is allowed to flow both laterally and heightwise. As the bottom of the wall of the groove 22 is precisely located over, and then downwardly upon, the yieldingly descending kick-out 44, the brief moment of vertical displacement affords time for further self-accommodation of the can end and especially its panel 23 in order to exactly determine a line of weakening designated L (FIGS. 5–7) (in this instance a fractured but integral section) to be effected by the score tool 46, or more particularly its end 52, as best shown in FIG. 5.

Figure 5:
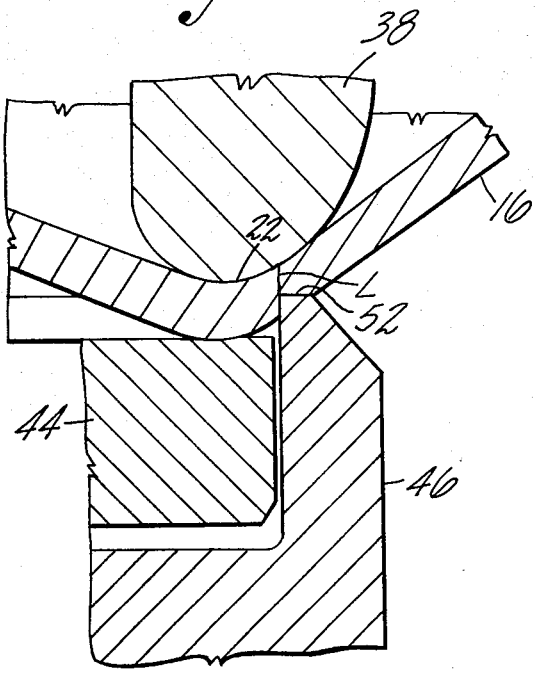
FIG. 5 is a further enlarged detail showing a coining operation forming the weakening line, in this case a fractured but integral section, of the closure.
Figure 6:
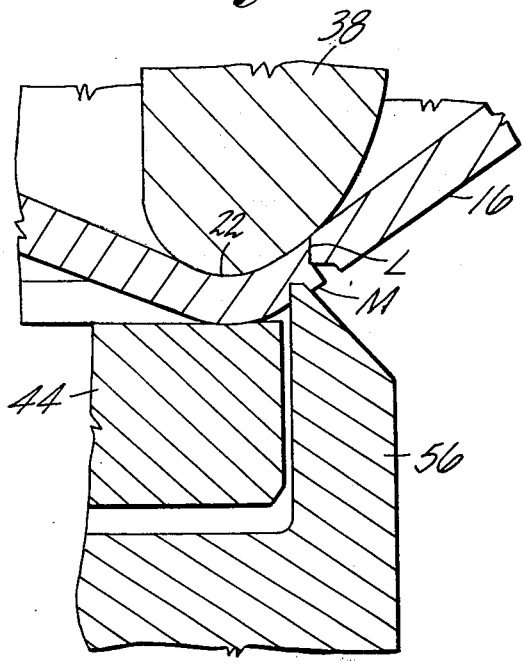
FIGS. 6 and 7 are sections similar to FIG. 5, illustrating successive further closure making steps, assuming the technique disclosed in the pending application Ser. No. 908,733, above mentioned is pursued.
Figure 7:
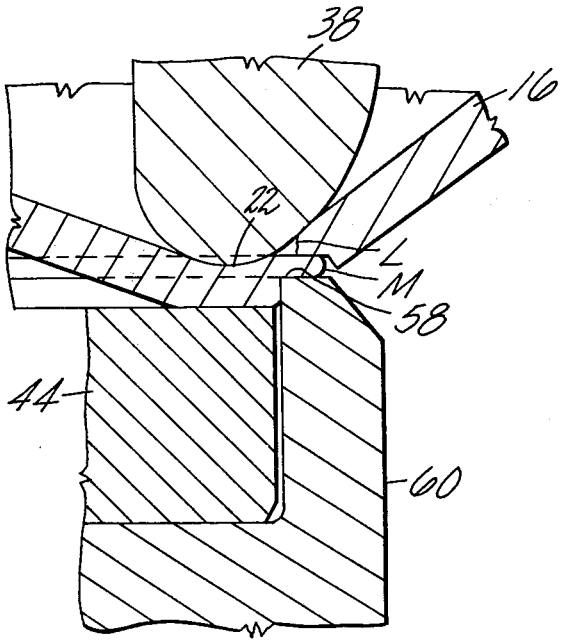

While the particular weakening line L may be of other character than "fractured-but-integral", the remaining preferred sequence of the closure making technique will now be further described referring to FIGS. 5–7. Upon relative retraction of the coining tool 46 from the cover 16 and reindexing of the belt 12, a next station (FIG. 6) employs another upper dowelling-forming die 36 with its locating ridge 38 seated in the groove 22 of the fractured cover 16. As the knock-out 44 of the station of FIG. 6 yieldingly abuts the closure wall on its side opposite the groove 22, a relatively narrow-ended swaging tool 56 penetrates the under wall of the closure 24 to establish a strip of swageable metal M which is bent radially outwardly to partly overlap an end of the fractured section L. In the final forming step (FIG. 7) after belt indexing, the strip M is further swaged radially outward at another press station which may once again employ a dowelling-forming die 36 with locating ridge 38 to seal the weakening line more tightly. In this station a wider working end 58 than used in prior stations is preferably provided by a swage 60.

Upon completion of the closure 24 as described, the upper tools 36,40 retract relative to the lower tool 60, and upward movement of the knock-out 44 frees the can top 16 with its completed easy-open closure.

From the foregoing it will be appreciated that in the intervals at successive stations the play afforded by the pockets 14 permits the can ends 16 to be laterally and vertically shifted, thus preventing imposition of localized stress. The vertical travel typically permitted by the belt 12 is on the order of 0.150" to 0.200" importantly providing a time increment wherein each can end is "unloaded", i.e. made substantially free of constraint and enabled to adjust to the successive positioning being precisely imposed by the tools 36,40 and 44 of the successive stations just prior to full cooperation with the lower tools of the stations. Thus at each stations as the belt 12 stops for closure making, the depressors relieve clamping pressure on the can end flanges 18 and the die ridge 38 is brought to bear in the correspondingly shaped groove 22 to accurately align the self-accommodating end with the cooperative lower tools. Each operation is thus effected in exactly the desired dimensional relation to a preceding operation and in a way that avoids creating harmful localized stress and resulting deformation or distortion in the can ends.

Finally, it will be appreciated that the invention, though making use of elements hitherto largely known in the art, is distinguished in their novel combination and method employed, attaining the higher degree of can end positioning accuracy and hence precision closures incident to improved product performance without entailing additional expense.

It will be understood that it is not necessary to the practice of this invention to utilize the carrier means 12 or its equivalent for indexing or actually conveying the workpieces 16, since the carrier means may function simply as a work holder or container for the workpieces; other mechanism may be relied on for moving the work from one station to the next. "Carrier means" or "carrier" in the claims may accordingly comprehend a holder or container.

We claim:

1. In a punch press having a carrier means for holding and sequentially moving sheet metal workpieces with limited lateral and heightwise play to and through at least two stations, each of the stations including at least one pair of upper and lower axially cooperative forming dies, the improvement comprising: at least an initial one of the pairs of the series of dies adapted to form a registerable feature in each workpiece, and mechanism for relieving holding pressure between the carrier means and the workpieces when at a station subsequent to the initial one and during an initial phase of die closure whereby a die of each pair following said initial one is enabled to register with said feature as the workpiece is thereby allowed self-positioning accommodation immediately prior to die forming operations at the successive stations.

2. A punch press as in claim 1 wherein the press includes guides for the carrier means, the carrier means is a belt having uniformly and longitudinally spaced openings for respectively loosely receiving can ends to be supported by their peripheral flanges, opposite margins of the belt having a running fit with said guides, said pressure relieving mechanism is operatively connected to an upper or lower forming die of each pair, and the stations are adapted to form a closure-defining weakening line in each can end to facilitate subsequent easy opening thereof.

3. A press as in claim 1 or 2 wherein said mechanism for relieving said holding pressure comprises at least one member engageable at each station with one side of the carrier means continuously to urge it axially of the dies in one direction, and at least one element engageable with the opposite side of the carrier means and actuatable by the closure, including partial closure, of the dies to resist displacement of the carrier means in said one direction.

4. A press as in claim 2 wherein said pressure relieving means comprises a countersink ring for nesting with a peripheral groove in each end and fitted with one or more depressors engageable with said carrier means adjacent said flanges, and the closure forming die is relatively reciprocable with said ring axially, said depressors being arranged to abut the carrier means prior to engagements of the ring and closure forming die with the workpiece to shift load from the can end flanges to said closure forming die.

5. The method of forming sheet metal can ends, respectively, with integral push-type closures in successive forming stations of a press, the press comprising a carrier having pockets for retaining each of the ends as they pass from station to station, said method comprising: initially forming the ends at one or more stations with an internal die registering surface feature and peripheral flanges retainable with margins of the pockets, and maintaining accurate registerability of at least one of the dies at subsequent stations with said feature by relieving pressure between the flanges and margins of the pockets immediately preceding each closure of the dies whereby the can ends are enabled to accomodate and self-position themselves in their respective pockets and laterally and heightwise of the dies for critical forming of the closures.

6. The method of making easy-open closures in can ends, the closures to be defined at least in part by a weakening line, said method comprising providing a series of press stations respectively including upper and lower axially cooperative sets of dies, the upper or lower of the respective sets including in coupled relation a larger registering die receivable in a peripheral groove of each can end and a closure-forming die corresponding generally to the shape of said line, feeding and indexing a vertically yieldable carrier loosely supporting successive can ends by their margins to present them between the die sets, and during closure of the upper and lower die sets of each station yieldably depressing the carrier portion therebetween to relieve its pressure on the can end margins whereby each can end can first laterally self-adjust its position relative to the registering die and thereafter both laterally and vertically with respect to the closure-forming die.

7. A press cyclically operable to produce sheet metal can ends respectively including easy-open portions, the press comprising: at least two stations, each having upper and lower cooperative pairs of forming dies registerable with a feature of successively fed can ends, carrier means for laterally advancing the can ends to and through the successive stations, and mechanism operable at a station subsequent to the first and engageable heightwise with the carrier means to relieve its supporting load on a can end at said stations during closure of the pairs of dies thereat in order to facilitate their accommodation of the feature.

8. A press as in claim 7 wherein said mechanism comprises a resilient means for urging the carrier means upwardly, and a depressor operatively connected to a die of each pair and arranged to act in each cycle on the resilient means ahead of the forming action of said pair on a can end.

9. In a punch press having carrier means for holding sheet metal workpieces with limited lateral and heightwise play to be processed through at least two stations, each of the stations including at least one pair of upper and lower axially cooperative forming dies, the improvement comprising: at least an initial one of the pairs of the series of dies adapted to form a registerable feature in each workpiece, and mechanism for relieving holding pressure between the carrier means and the workpieces when at successive stations and during an initial phase of die closure whereby a die of each pair following said initial one is enabled to register with said feature as the workpiece is thereby allowed self-positioning accommodation immediately prior to die forming operations at the successive stations.

10. The method of forming sheet metal can ends, respectively, with integral push-type closures in the successive forming stations of a press, the press comprising a carrier means having pockets for holding each of the ends between closeable pairs of axially cooperative dies, said method comprising: initially forming the ends with an internal die registering surface feature and peripheral flanges engageable with margins of the pockets, and maintaining accurate registerability of at least one of the dies of each successive station with said feature by relieving pressure and hence the constraining friction between said end flanges and the pocket margins immediately preceding each closure of the dies whereby the can ends are enabled to accommodate and self-position themselves in their respective pockets and laterally and heightwise of the dies for critical forming of the closures.

* * * * *